US008971745B2

(12) United States Patent
Isobe et al.

(10) Patent No.: US 8,971,745 B2
(45) Date of Patent: Mar. 3, 2015

(54) IMAGE FORMING APPARATUS

(71) Applicants: Akifumi Isobe, Saitama (JP); Hiroyuki Futami, Tokyo (JP); Akira Okamoto, Tokyo (JP); Kenji Yamamoto, Tokyo (JP); Hideki Nakamura, Tokyo (JP); Katsuyuki Ikuta, Shizuoka (JP)

(72) Inventors: Akifumi Isobe, Saitama (JP); Hiroyuki Futami, Tokyo (JP); Akira Okamoto, Tokyo (JP); Kenji Yamamoto, Tokyo (JP); Hideki Nakamura, Tokyo (JP); Katsuyuki Ikuta, Shizuoka (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 50 days.

(21) Appl. No.: 13/692,411

(22) Filed: Dec. 3, 2012

(65) Prior Publication Data

US 2013/0142534 A1 Jun. 6, 2013

(30) Foreign Application Priority Data

Dec. 6, 2011 (JP) ..... 2011-267009

(51) Int. Cl.
*G03G 15/20* (2006.01)
*G03G 15/00* (2006.01)

(52) U.S. Cl.
CPC ..... *G03G 15/20* (2013.01); *G03G 15/2021* (2013.01); *G03G 15/6588* (2013.01); *G03G 2215/00514* (2013.01); *G03G 2215/2006* (2013.01)
USPC ..... 399/67; 399/320

(58) Field of Classification Search
USPC ..... 399/67
See application file for complete search history.

(56) References Cited

U.S. PATENT DOCUMENTS

| | | | | |
|---|---|---|---|---|
| 4,972,236 | A * | 11/1990 | Hasegawa | 399/16 |
| 2004/0190956 | A1* | 9/2004 | Senda | 399/328 |
| 2009/0060541 | A1* | 3/2009 | Takeuchi | 399/45 |
| 2010/0278575 | A1 | 11/2010 | Mizuno et al. | |

FOREIGN PATENT DOCUMENTS

| | | |
|---|---|---|
| JP | 08-234605 | 9/1996 |
| JP | 2008-058365 | 3/2008 |
| JP | 2009-063629 | 3/2009 |
| JP | 2010-260680 | 11/2010 |

OTHER PUBLICATIONS

European Search Report EP 12 19 4836 (date of completion Jun. 3, 2013) (5 pages).

* cited by examiner

*Primary Examiner* — Clayton E LaBalle
*Assistant Examiner* — Jas Sanghera
(74) *Attorney, Agent, or Firm* — Lucas & Mercanti, LLP

(57) ABSTRACT

An image forming apparatus includes first and second image-forming portions and an intermediate transporting portion. A control unit checks fixing units in the image-forming portions and determines whether or not the fixing unit in the first image-forming portion is a fixing unit for an envelope. If not, the control unit controls a manipulation and display unit to display guidance for urging a user to exchange the first fixing unit. If so, the control unit determines whether or not too fixing unit in the second image-forming portion is a fixing unit for an envelope. If not, the control portion controls a manipulation and display unit to display a guidance for urging a user to exchange the second fixing unit. If both of fixing units in the first and second image-forming portions are fixing units for the envelope, the control unit allows an envelope mode control operation.

19 Claims, 8 Drawing Sheets

IMAGE FORMING APPARATUS

CROSS REFERENCE TO RELATED APPLICATION

The present invent ion is based on Japanese Patent Application No. 2011-267009 filed with Japanese Patent Office on Dec. 6, 2011, the entire contents of which being hereby incorporated by reference.

BACKGROUND OF THE INVENTION

1. Field of the Invention

The present invention relates to an image forming apparatus of tandem type in which plural copying portions are connected in series to perform a duplex printing or copying on both surfaces of a sheet of paper including an envelope.

2. Description of Related Art

An image forming apparatus of tandem type in which plural copying portions are connected in series to perform a duplex printing or copying or the like has been put into practical use in recent years. For example, in the image forming apparatus of tandem type in which two copying portions are connected in series, a copying portion at upstream side forms an image on a surface of a sheet of paper; an intermediate transporting portion provided between the copying portion at the upstream side and a copying portion at downstream side reverses a surface of the sheet of paper; and the copying portion at the downstream side forms an image on a back surface of the sheet of paper.

Japanese Patent Application Publication No. H08-234605 has disclosed, as each an image forming apparatus of tandem type in which two copying portions are connected in series, a duplex printing machine in which two electrophotography apparatuses are connected in series, wherein a near roller and a heater are standardized in a first electrophotography apparatus for printing an image on a surface of a sheet of paper and a second electrophotography apparatus for printing an image on a back surface of the sheet of paper.

Such an image forming apparatus of tandem type has been widely used even so a case where an irregular sheet of paper such as an envelope is printed or copied in addition to any regular sheet of paper of A3 size or the like. When printing or copying an image on the envelope, a fixing condition or the like such as temperature control, fixing speed, nipping width by fixing rollers and a nipping pressure thereby is different from that used when printing or copying an image on the regular shoes of paper. Therefore, a special fixing unit for the envelope is used in addition to a standard regular fixing unit. Accordingly, when printing or copying an image on an envelope, the envelope is printed or copied after the regular fixing unit fitted into a fixing unit fitting portion of each copying portion has been exchanged to the fixing unit for the envelope.

SUMMARY OF THE INVENTION

Such an image forming apparatus of tandem type, however, has no configuration so that a fixing processing is not allowed before both of the fixing units in the two copying portions have been exchanged to any fixing units for the envelope. Namely, in such an image forming apparatus of tandem type, the image forming apparatus has printed or copied images on the envelope apart from any conditions of the fixing units. As described above, depending on a species of envelope, it may be necessary to optimize the fixing condition such, as temperature control and fixing speed. If the standard regular fixing unit fixes the envelope without optimizing any fixing condition, the envelope may suffer any creases.

This invention addresses the above-mentioned issue and has an object to provide an improved image forming apparatus which may prevent the envelope from suffering any creases when printing or copying image(s) on the envelope in the image forming apparatus of tandem type in which plural copying portions are connected in series.

To achieve the above-mentioned object, an image forming apparatus reflecting a first aspect of the present invention contains a first copying portion including a first image forming unit that forms a first image on a sheet of paper containing en envelope, and a first fixing unit that fixes the first image formed by the first copying portion on the sheet of pager containing the envelope, a second copying portion including a second image forming unit that forms a second image on the sheet of paper containing the envelope, and a second fixing unit that fixes the second image formed by the second copying portion on the sheet of paper containing the envelope, the second copying portion being connected in series to the first copying portion at downstream side of the first copying portion along a transporting direction of the sheet of paper, and a control portion that is configured to watch the first and second fixing units and to allow an envelope mode control operation to form the first and second images on the envelope when determining that both of the first and second fixing units are fixing units for the envelope, which fix the first and second images on the envelope.

As a second aspect of the present invention, it is desirable to provide the image forming apparatus of the first aspect of the present invention further containing an informing portion that urges a user to exchange at least one of the first and second fixing units, wherein when determining that any one of the first and second fixing units is the fixing unit for the envelope, the control portion is configured to control the informing portion to inform the user of a guidance for exchanging the other fixing unit which is determined to be not the fixing unit for the envelope from the existing fixing unit to the fixing unit for the envelope.

As a third aspect of the present invention, it is also desirable to provide the image lemming apparatus of the first aspect, wherein when determining that both of the first and second fixing units are fixing units for a regular sheet of paper, which fix the first and second images on the regular sheet of paper, the control portion is configured to allow a regular mode control operation to form the first and second images on the regular sheet of paper.

As a fourth aspect of the present invention, it is further desirable to provide the image forming apparatus of the first aspect further containing a manipulation portion which selects the envelope mode control operation, wherein the control portion is configured to allow the envelope mode control operation when the manipulation portion selects the envelope mode control operation and the control portion determines that both of the first and second fixing units are the fixing units for the envelope.

As a fifth aspect of the present invention, it is additionally desirable to provide the image forming apparatus of fourth aspect, wherein the manipulation portion is configured to be able to select a regular mode control operation to form the first and second images on a regular sheet of paper, and the control portion is configured to allow the regular mode control operation when the manipulation portion selects the regular mode control operation and the control portion determines that both of the first and second fixing units are fixing units for the regular sheet of paper, which fix the first and second images on the regular sheet of paper.

As a sixth aspect of the present invention, it is still further desirable to provide the image forming apparatus of the first respect further containing plural sheet-feeding trays, each tray setting the sheet of paper including the envelope, and a manipulation portion which selects the envelope as a setting item for the sheet-feeding trays, wherein the control portion is configured to allow the envelope mode control operation when the manipulation portion selects the envelope as the setting item for the sheet-feeding trays and selects the sheet-feeding tray in which the envelops is set and the control portion determines that both of the first and second fixing units are fixing units for the envelope.

As a seventh aspect of the present invention, it is also desirable to provide the image forming apparatus of the first aspect further containing a sheet-feeding tray that sets the sheet of paper including the envelope, and a defecting unit that detects whether or not the envelope is set in the sheet-feeding tray, wherein the control portion is configured to allow the envelope mode control operation when determining that the envelope as set in the sheet-feeding tray based on a result of the detection by the detecting unit and determining that both of the first and second fixing units are fixing units for the envelope.

As an eighth aspect of the present invention, it is further desirable to provide the image forming apparatus of the first aspect further containing an intermediate transporting portion that is positioned between the first and second copying portions and transports the sheet of paper including the envelope transported from the first copying portion to the second copying portion while a surface of the sheet of paper is reversed without any interchange of front and behind in the sheet of paper.

In this invention, the terms, "a sheet of paper" includes a regular sheet of paper of A3 or A4 size or the like and an irregular sheet of paper such as an envelope. The terms, "regular sheet of paper" are referred to as "standard regular sheet of paper". The term, "envelope" includes "irregular sheet of paper". The term, "image(s)" contain(s) any information of letters and/or devices to be printed or copied on, for example, the envelope. The terms, "envelope mode" are referred to as "a mode in which an image such as letters is formed on the envelope using the first and second fixing units, which is allowed when both of the first and second fixing units in the first and second copying portions are fixing units for the envelope". The terms, "regular mode" are referred to as "a mode in which an image is formed on the regular sheet of paper using the first and second fixing units, which is allowed when both of the first and second fixing units in the first and second copying portions are fixing units for the regular sheet of paper".

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DETAILED DESCRIPTION OF THE PREFERRED EMBODIMENTS

The following will describe embodiments of this invention with reference to the drawings.

1. First Embodiment

Configuration Example of Image Forming Apparatus

Figure 1:
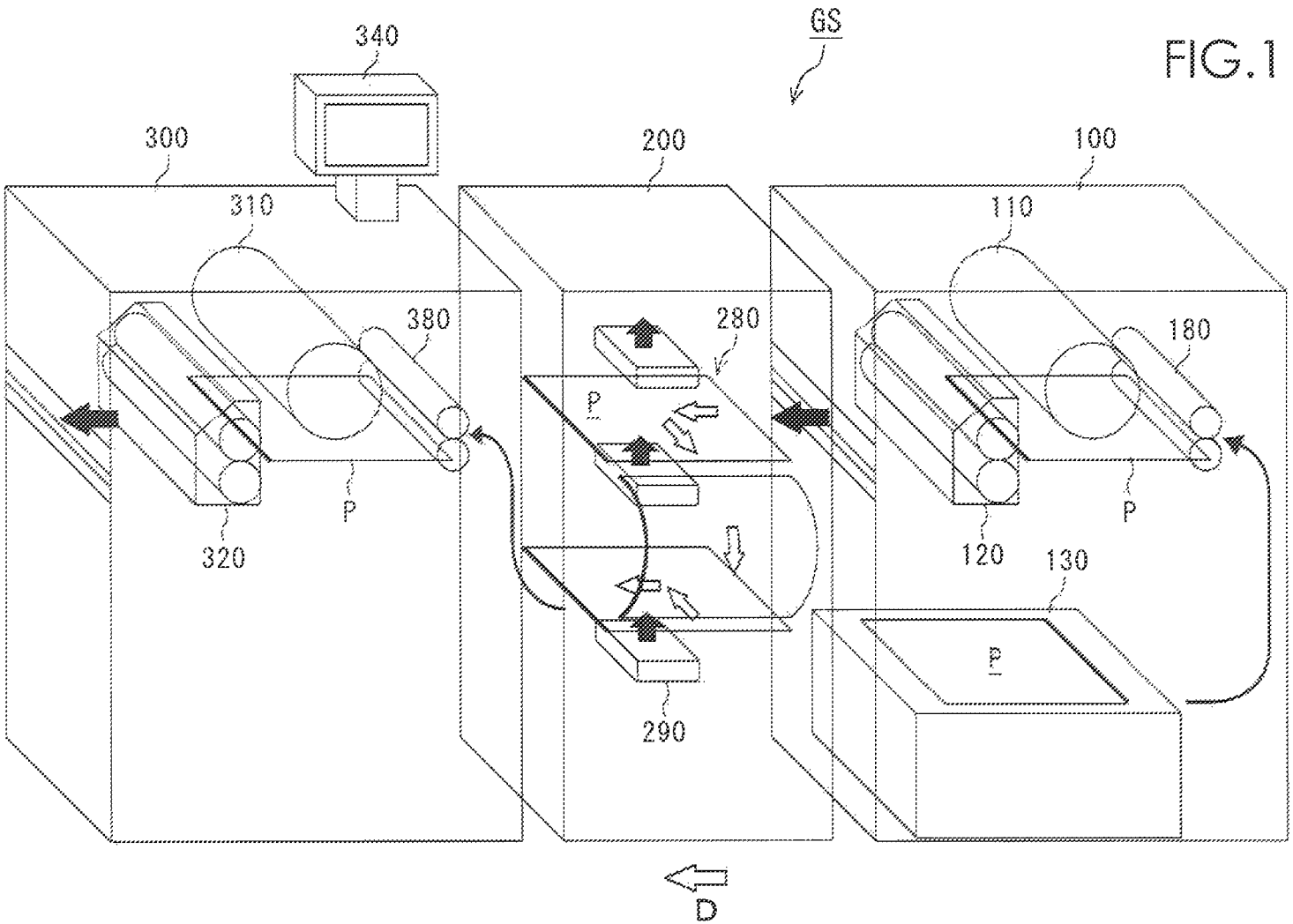
FIG. 1 is a diagram showing a configuration example of an image forming apparatus according to a first embodiment of this invention.

FIG. 1 shows a configuration example of an image forming apparatus GS according to a first embodiment of this invention. If is to be noted that dimensions and/or ratios in the drawings are exaggerated for convenience of explanation and they may be different from actual ones. The following will describe a case where images such as letters are formed on both surfaces of an envelope P as an example of a sheet of paper.

As shown in FIG. 1, the image forming apparatus GS is an image forming apparatus of tandem type in which a first copying portion 100, an intermediate transporting portion 200 and a second copying portion 300 are connected in series along a transporting direction D of a sheet of paper. A control portion of the image forming apparatus GS performs fixing-unit-checking operation, namely, checks a first fixing unit 120 in the first copying portion 100 at upstream side along the transporting direction D of the sheet of paper and a second fixing unit 320 in the second copying portion 300 at downstream side along the transporting direction D of the sheet of paper, when printing or copying the envelope P, whether or not both of the first and second fixing units 120, 320 are fixing units for the envelope. When both of the first and second fixing units 120, 320 are the fixing units for the envelope, the control portion allows the envelope to be printed. The first copying portion 100 and the second copying portion 300 have almost the same configuration and function as each other.

Configuration Example of First Copying Portion

The first copying portion 100 contains a paper-feeding unit 130, registration rollers 180, a first image-forming unit 110 and a first fixing unit 120. It is to be noted that detailed configuration of an image reading unit and an image-forming unit such as an exposing unit and a developing unit will be omitted for convenience in order to simplify the description thereof.

The sheet-feeding unit 130 includes plural sheet-feeding trays. In each of the sheet-feeding trays, regular sheets of paper such as sheets of paper of A4 or A3 size or irregular sheets of paper such as the envelopes P are set. In this embodiment, the envelopes P are set in the sheet-feeding tray. Pick-up rollers or the like take out the envelopes P one by one from the sheet-feeding tray. Transporting rollers or the like transport the taken-out envelope P to the registration rollers 180. In this moment, in order to avoid dragging the envelope P by its flap, the envelope P is transported, with its bottom side which is positioned at the other side of the flap being led. In FIG. 1, solid line illustrates a leading edge of the envelope P, namely, the bottom side of the envelope P. It is to be noted that a single or plural of large capacity feeder(s) that can contain many envelopes P may be set near the first copying portion 100 at the upstream side along the transporting direction D of the sheet of paper, if necessary.

The registration rollers 180 forms a loop of the envelope P when the leading edge of the envelope P transported from the paper-feeding unit 130 is hit against the registration rollers 180 so that the sheet F can be deskewed. Further, the registration rollers 180 nip the envelope P and shifts if to a direction which is perpendicular to the transporting direction D of the envelope P based on a defection result of the deflection-detecting sensor, not shown, to correct the deflection of the envelope P. The registration rollers 180 then transport the envelope P which has been already deskewed and corrected in its deflection to the first image-forming unit 110 at a predetermined timing.

The first image-forming unit 110 contains, for example, photosensitive drum and the like. The first image-forming unit 110 transfers any toner image formed around a surface of the photosensitive drum by the exposing unit, the developing unit and the like in the first image-forming unit 110 to a surface of the envelope P transported by the registration rollers 180. It is to foe noted chat although the photosensitive drum is configured to be a single in this embodiment so that, monochrome mage can be formed, a color image may be formed by using photosensitive drams of yellow (Y), magenta (M), cyan (C) and black (K), an intermediate transfer belt and the like.

The first fixing unit 120 is composed of, for example, a heating roller that contains a heater and a pressure roller that is arranged so as to be opposed to the heating roller. The first fixing unit 120 fixes the toner image on the envelope P by heating and pressing the envelope P, to the surface of which the toner image has been transferred by the first image-forming unit 110. The first fixing unit 120 is arranged to be detachable from a unit installing part in an apparatus main body. The first fixing unit 120 includes a regular fixing unit for fixing the regular sheet of paper such as sheet of paper of A3 size and a fixing unit for the envelope P, which fixes the envelope P, as species of the first fixing unit 120. The first fixing unit 120 is suitably exchanged according to species of the sheet of paper to be used. The fixing unit for the envelope P is configured so that its fixing conditions such as temperature control, fixing speed, a nipping width by the fixing rollers, and nipping pressure may be optimized to the envelope. Similarly, the regular fixing unit is configured so that its fixing conditions such as a nipping width by the fixing rollers and the like may be optimized to the regular sheet of paper. The envelope P which the first fixing unit 120 has fixed is ejected to the following intermediate transporting portion 200 through paper ejection roller, not shown or the like.

Configuration Example of Intermediate Transporting Portion

The intermediate transporting portion 200 is arranged between the first and second copying portions 100, 300 at downstream side of the first copying portion 100 along the transporting direction D of the sheet of paper. The intermediate transporting portion 200 includes a same edge reverse mechanism 280 and a cooling unit 290.

The same edge reverse mechanism 280 has a transporting path, which arranged upward and downward along the transporting direction D of the envelope P, and a reverse path of loop shape, which is arranged in a direction which is perpendicular to the transporting direction D of the envelope P. The same edge reverse mechanism 280 passes the envelope P ejected from the first copying portion 100 through the reverse path of loop shape to turn it by 180 degrees so that the envelope P, a surface of which is reversed, may be fed to the second copying portion 300 without any interchange of front and behind in the envelope P. As the same edge reverse mechanism 280, for example, reverse mechanism disclosed by Japanese Patent Application Publication No. 2010-260680 is incorporated thereto by reference.

Each of the cooling units 290 is composed of, for example, a cooling fan. The cooling units 290 are respectively arranged on the transporting paths in the same edge reverse mechanism 280. The cooling units 290 send air to guide plates constituting each transporting path to cool the envelope P heated by the first fixing unit 120 in the first copying portion 100. At the same time, the cooling units 290 cool the guide plates constituting each transporting path, which are heated through heat transfer by the heated envelope P. Thus, the cooled envelope P may be fed to the second copying portion 300. This enables the temperature conditions of the first and second image-forming units 110, 310 at the upstream and downstream sides to be conformed to each other.

Configuration Example of Second Copying Portion

The second copying portion 300 contains registration rollers 380, a second image-forming unit 310, a second fixing unit 320 and a manipulation and display unit 340. It is to be noted that detailed configuration of an image reacting an it and an image-forming unit such as an exposing unit and a developing unit will be omitted for convenience in order to simplify the description thereof. The second copying portion 300 has the same configuration and function as those of the first copying portion 100 so that any descriptions or the common parts will be omitted. The second image-forming unit 310 forms an image such as letters on a rear surface of the envelope P, a surface of which is reversed by the same edge reverse mechanism 280 of the intermediate transporting portion 200.

The second fixing unit 320 is composed of, for example, a heating roller that contains a hearer and a pressure roller that is arranged so as to be opposed to the heating roller. The second fixing unit 320 fixes the toner image on the envelope a by heating and pressing the envelope P, to the rear surface of which the toner image has been transferred by the second image-forming unit 310. The second fixing unit 320 is arranged to be detachable from a unit installing part in an apparatus main body. The second fixing unit 320 includes a regular fixing unit for fixing the regular sheer of paper such as sheet of paper of A3 size and a fixing unit for the envelope P, which fixes the envelope P, as species of the second fixing unit 320. The second fixing unit 120 is suitably exchanged according to species of the sheet of paper to be used. The fixing unit for the envelope P is configured so that its fixing conditions such as the temperature control, the fixing speed, the nipping width by the fixing rollers and the nip pressure may be optimized to the envelope. Similarly, the regular fixing unit is configured so that its fixing conditions such as a nipping width by the fixing rollers and the like may be optimized to the regular sheet of paper.

The envelope P which the second fixing unit 320 has fixed is ejected to a paper-ejection tray through paper ejection roller, not shown, or is ejected to a downstream device arranged at a downstream side of the second copying portion 300 along the transporting direction D of the envelope P.

The manipulation and display unit 340 is configured to have a touch screen in which a display device composed of liquid crystal display panel and the like and a pointing device operated by a capacitance system, a resistive film system or the like are combined. The manipulation and display unit 340 is installed on a case constituting the second copying portion 300. For example, the manipulation and display unit 340 receives any conditions for forming an image such as size and species of a sheet of paper and/or receives any setting of the envelope mode or the regular mode when checking the fixing unit. The manipulation and display unit 340 may be installed on the first copying portion 100 or the intermediate transporting portion 200. The manipulation and display unit 340 may be also installed on all of the portions. It is to be noted that the manipulation and display unit 340 constitutes an informing portion.

Block Configuration Example of Image Forming Apparatus

Figure 2:
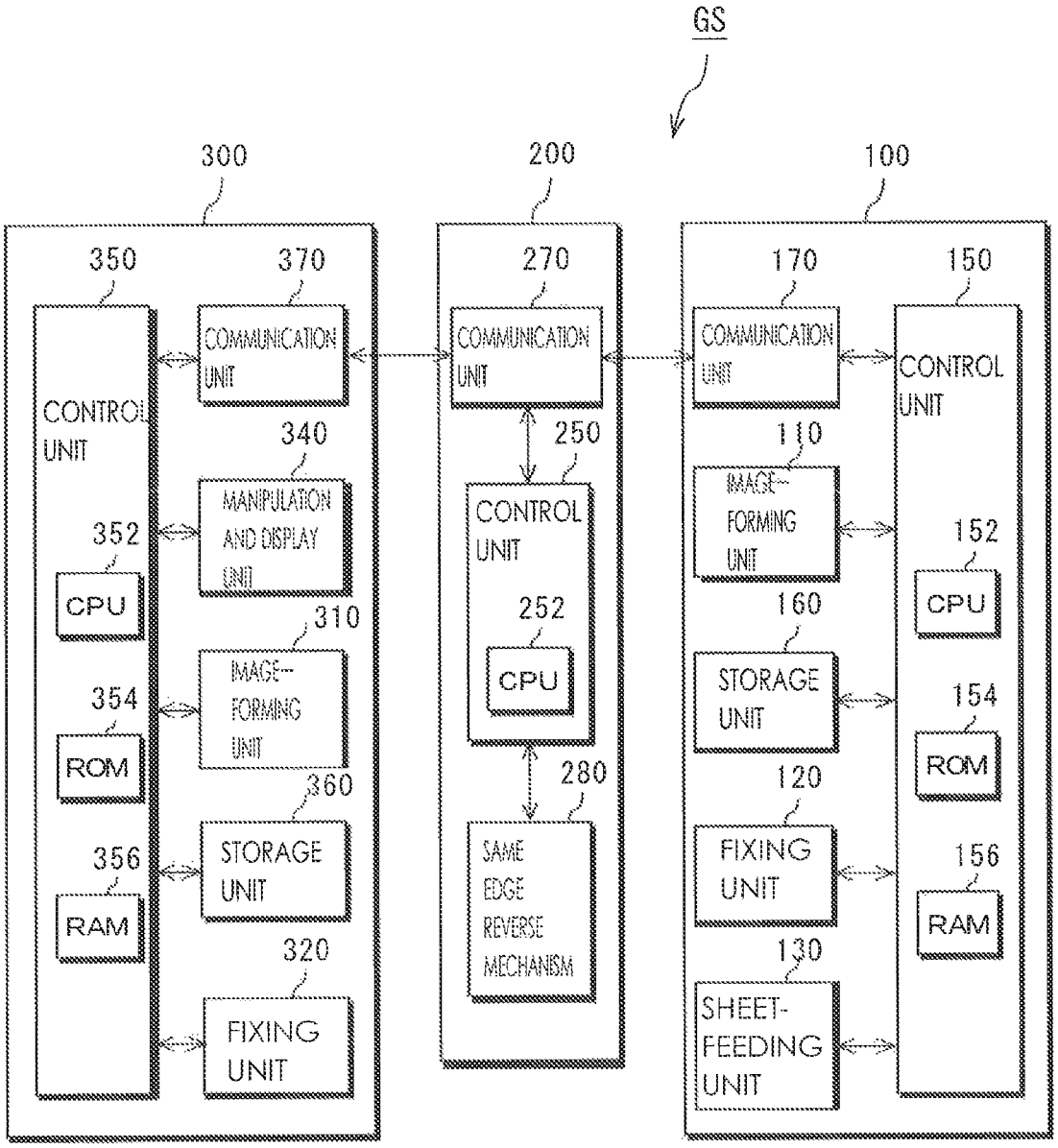
FIG. 2 is a block diagram showing a configuration of the image forming apparatus according to any of the first through fourth embodiments of this invention.

The following will describe an embodiment of a configuration example of the image forming apparatus GS. FIG. 2 illustrates the configuration example of the image terming apparatus GS according to the invention.

Block Configuration Example of First Copying Portion

As shown in FIG. 2, the first copying portion 100 contains a control unit 150 that controls an operation of whole of the first copying portion 100. The control unit 150 includes, for example, a central processing unit (CPU) 152, a read only memory (ROM) 154 and a random access memory (RAM) 156. The CPU 152 performs an image forming process including checking a fixing unit by reading any desired programs and/or data stored in the ROM 154, extracting them in the RAM 156 to execute the program and controlling an operation of each part of the first copying portion 100.

The control unit 150 connects a first image-forming unit 110, a storage unit 160, a first fixing unit 120, a sheet-feeding unit 130 and a communication unit 170, respectively.

The first image-forming unit 110 contains a photosensitive drum, charged device, laser unit, developing device and exposing device. The first image-forming unit 110 controls operation of the photosensitive drum based on a control signal supplied from the control unit 150 to form an image such as letters on a surface of the envelope P by means of, for example, electrophotography system.

The storage unit 160 is configured to include a nonvolatile semiconductor device, a hard disk drive (HDD) and the like. The storage unit 160 temporarily stores any image data or the like, which is generated by the image reading portion, based on a control signal supplied from the control unit 150.

The first fixing unit 120 fixes on the envelope P a toner image transfer real to the surface of true envelope P by performing, for example, any temperature control on heater(s) and any transport control of a sheet of paper such as the envelope P. The first fixing unit 120 is configured so that a fixing unit for the envelope or a regular fixing unit is detachable therefrom. The first fixing unit 120 supplies identification information for identifying the fixing unit installed in the unit-installing part to the control unit 150.

The sheet-feeding unit 130 takes a sheet of paper out of the selected sheet-feeding tray cased on a control signal identifying the selected sheet-feeding tray, which is received from the control unit 150. The sheet-feeding unit 130 then transports the sheet of paper to the first image-forming unit 110.

The communication unit 170 is configured to include serial communication interfaces. The communication unit 170 performs bidirectional communication of the data to or from the intermediate transporting portion 200 and/or the second copying portion 300 together with them.

Block Configuration Example of Intermediate Transporting Portion

The intermediate transporting portion 200 contains a control unit 250 including CPU 252 that controls an operation of whole of the intermediate transporting portion 200. The control unit 250 connects a communication unit 270 and the same edge reverse mechanism 230, respectively. The communication unit 270 is composed of, for example, a serial communication interface. The communication unit 270 performs bidirectional communication of the data to or from the first copying portion 100 and/or the second copying portion 300 together with them.

The same edge reverse mechanism 280 is provided with plural transporting rollers, not shown, which are set on rise transporting path, a driving motor, not shown, which drives these transporting rollers, a contact-controlling motor, not shown, which controls the transporting rollers to come into contact with each other, and plural sensors, not shown, which detect the envelope P being transported by the transporting rollers. They are controlled by the control unit 250 so that a surface of the envelope P can be reversed without any interchange of front and behind in the envelope P and the reversed envelope P can be transported to the second copying portion 300.

Block Configuration Example of Second Copying Portion

As shown in FIG. 2, the second copying portion 300 contains a control unit 350 that controls an operation of whole of the second copying portion 300. The control unit 350 includes, for example, CPU 352, ROM 354 and RAM 356. The CPU 352 performs an image forming process including checking a fixing unit by reading any desired programs and/or data stored in the ROM 354, extracting them in the RAM 356 to execute the program and controlling operations of each part of the second copying portion 300. In the operation of checking the fixing units, the control unit 350 watches species (condition) of the first fixing unit 120 of the first copying portion 100 and species (condition) of the second fixing unit 120 of the second copying portion 300 to determine whether or not both of the filing units 120, 320 are the fixing units for the envelope.

The control unit 350 connects a second image-forming unit 310, a storage unit 360, the second fixing unit 320, the manipulation and display unit 340 and a communication unit 370, respectively.

The second image-forming unit 310 contains a photosensitive drum, charged device, laser unit, developing device and exposing device. The second image-forming unit 310 controls operation of the photosensitive drum and the like based on a control signal supplied from the control unit 350 to form an image such as letters on a back surface of the envelope P by means of, for example, electrophotography system.

The storage unit 360 is configured to include a nonvolatile semiconductor device, a hard disk drive (HDD) and the like. The storage unit 360 temporarily stores any image data or the like, which is generated by the image reading portion, based on a control signal supplied from the control unit 350.

The second fixing unit 320 fixes en the envelope P a toner image transferred to the back surface of the envelope P by performing, for example, any temperature control on heater (s) and any transport control of a sheet of paper such as the envelope P. The second fixing unit 320 is configured so that a fixing unit for the envelope or a regular fixing unit is detachable therefrom. The second fixing unit 320 supplies identification information of a port identifying the fixing unit installed in the unit-installing part to the control unit 350.

The communication unit 370 is configured to include serial communication interfaces. The communication unit 370 performs bidirectional communication of the data to or from the intermediate transporting portion 200 and/or the first copying portion 100 together with them.

Based on an instruction of the control unit 350, the manipulation and display unit 340, which is an information portion, displays image-forming conditions such as size and/or species of the sheet of paper and/or a sheet-feeding tray to be selected on a management screen thereof. The manipulation and display unit 340 also displays a result of checking the fixing units at upstream and downstream sides and/or guidance for urging a user to exchange any fixing unit. Further, the manipulation and display unit 340 receives any input on a side and/or species of sheet of paper which has been selected on the management screen (menu screen) and supplies a management signal according to the input to the control unit 350.

Operation Example of Image Forming Apparatus

Figure 3:
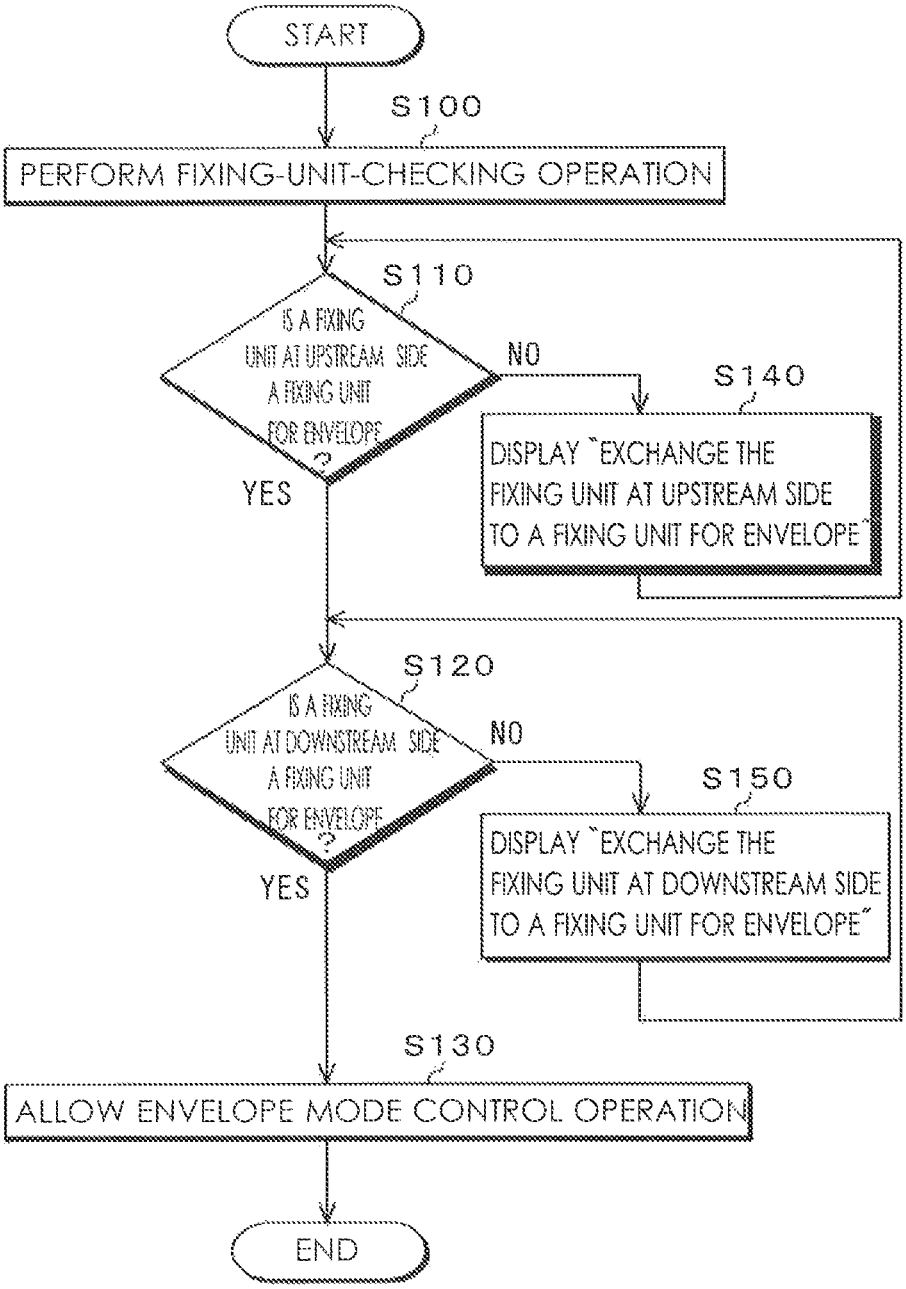
FIG. 3 is a flowchart showing an operation example of the image forming apparatus according to the first embodiment of this invention during an operation time for checking fixing units.

FIG. 3 shows an operation example of the image forming apparatus GS according to the first embodiment of this invention during an operation time for checking the fixing units. The following will describe a case where the control unit 350 of the second copying portion 300 is a main controller and controls the imago forming apparatus GS together writ the control unit 100 of the first copying portion 100 and the control unit 250 of the intermediate transporting unit 200.

As shown in FIG. 3, at a step S100, the control unit 350 performs a fixing-unit-checking operation to check the fixing units at an initialization operation thereof when the power of image forming apparatus GS is on. At a step S110, the control unit 350 determines whether or not the fixing unit 120 of the first copying portion 100 is a fixing unit for the envelope. As the determination method, at the initialization operation when the power of image forming apparatus GS is on, it is determined based on whether or not a flag is set to a pert indicating the fixing unit for the envelope. It may be determined based on whether or not there is a signal corresponding to a special operation for the fixing unit for the envelope, which the control unit 350 requests. The control unit 350 goes to a step S120 when it determines that the fixing unit 120 of the first copying portion 100 is a fixing unit for the envelope. The control unit 350 goes to a step S140 when it determines that the fixing unit 120 of the first copying portion 100 is not a fixing unit tor the envelope.

When the control unit 350 determines that the fixing unit 120 of the first copying portion 100 is not a fixing unit for the envelope, at the step S140, the control unit 350 controls the manipulation and display unit 340 to display on the management screen thereof a guidance for urging a user to exchange the fixing unit 120, for example, "Please change the fixing unit at upstream side from the existing fixing unit to a fixing unit for the envelope". In this moment, a speaker may be provided to carry out guidance by voice in addition to the displayed guidance. An alarm may sound by buzzer. The control unit 350 goes back to the step S110, after the guidance has been displayed on she screen, where the control unit 350 again determines whether or not the fixing unit 120 of the first copying portion 100 is exchanged to a fixing unit for the envelope based on she displayed guidance. For example, when exchanging the fixing unit 120 from the existing fixing unit to the fixing unit for the envelope after the power of the first copying portion 100 is off, the control unit 150 of the first copying portion 100 performs operation to check the fixing units at the initialization operation when the power of the first copying portion 100 is next on. When exchanging the fixing unit 120 from existing fixing unit to the fixing unit for the envelope while the power of the first copying portion 100 is not completely off, the control unit 150 of the first copying portion 100 performs the operation to check the fixing units while the fixing unit for the envelope is fitted to the unit-fitting portion of the first copying portion 100.

On the other hand, when the control unit 350 determines that the fixing unit 120 of the first copying portion 100 is a fixing unit for the envelope, at the step S120, the control unit 350 determines whether or not the fixing unit 320 of the second copying portion 300 is a fixing unit for the envelope. As the determination method, it is determined based on whether or not a flag is set to a port indicating the fixing unit tor the envelope, as described above. The control unit 350 goes to a step S130 when it determines that the fixing unit 320 of the second copying portion 300 is a fixing unit for the envelope. The control unit 350 goes to a step S150 when it determines that the fixing unit 320 of the second copying portion 300 is not a fixing unit for the envelope.

When the control unit 350 determines that the fixing unit 320 of the second copying portion 300 is not a fixing unit for the envelope, at the step S150, the control unit 350 controls the manipulation and display unit 340 to display on the management screen thereof a guidance for urging a user to exchange the fixing unit 320, for example, "Please change the fixing unit at downstream side from the existing fixing unit to a fixing unit for the envelope". In this moment, a speaker may be provided to carry out guidance by voice in addition to the displayed guidance. An alarm may sound by buzzer. The control unit 350 goes back to the step S110, after the guidance has been displayed on the screen, where the control unit 350 again determines whether or not the fixing unit 320 of the second copying portion 300 is exchanged to a fixing unit for the envelope based on the displayed guidance. At timing when the control unit 350 performs this determination is similar to that of the step S110.

When the control unit 350 determines that the fixing unit 220 of the second copying portion 300 is a fixing unit for the envelope, in other words, when both of the fixing units of the first and second copying portions are determined so as to be fixing an its for the envelope, at the step S130, the control unit 350 allows as envelope mode control operation to form the first and second images on the envelops. Accompanying this allowance of the envelope mode control operation, the control unit 350 applies a chance and an adjustment control of sheet-transporting speed for the fixing unit for the envelope, a temperature control in the fixing unit for the envelope and an output control in various hinds of high voltage power source for the envelope. Thus, the image forming apparatus GS prints or copies images on both surfaces of the envelope F under an optimal fixing condition for the envelope. In the image forming apparatus GS, such a series of operations is repeated.

As described above, in the first embodiment, the control unit 350 allows the envelope mode control operation when both of the fixing units 120, 320 of the first and second copying portions 100, 300 are determined so as to be fixing units for the envelope. In other words, the image forming apparatus GS has such a configuration that it cannot print or copy an image on the envelope P when any one of the fixing units 120, 320 of the first and second copying portions 100, 300 at upstream and downstream sides is determined so as to be a fixing unit for the envelope. Accordingly, when printing or copying images on both surfaces of the envelope P, a fixing condition such as temperature control, fixing speed, nipping width between the fixing rollers, and nipping pressure is made optimal for the envelope. This avoids the envelope from suffering any creases in the fixing process. Thus, the image forming apparatus GS can perform high quality printing or copying.

By the same edge reverse mechanism 200 according to this embodiment, a surface of the envelop P is reversed without any interchange of front and behind in the envelope P and is transported from the first copying portion 100 at upstream sloe to the second copying portion 300 at downstream side. This enables the envelope P to be transported with a flap of the envelope P being directed to a rear end side along the transporting direction D of the envelope P. Thus, the image forming apparatus GS according to this embodiment can perform excellent duplex printing. Accordingly, the image forming apparatus GS according to this embodiment avoids dragging the envelope P by its flap in the transporting time thereof.

2. Second Embodiment

The second embodiment is different from the first embodiment in that the control flow takes info consideration a case where neither fixing unit of upstream side nor fixing unit of downstream side is a fixing unit for an envelope. It is to be noted that other components and operations of the image forming apparatus GS according to this embodiment are identical to those of the first embodiment so that the identical components are indicated by line same reference numbers, a detailed explanation of which will be omitted.

Figure 4:
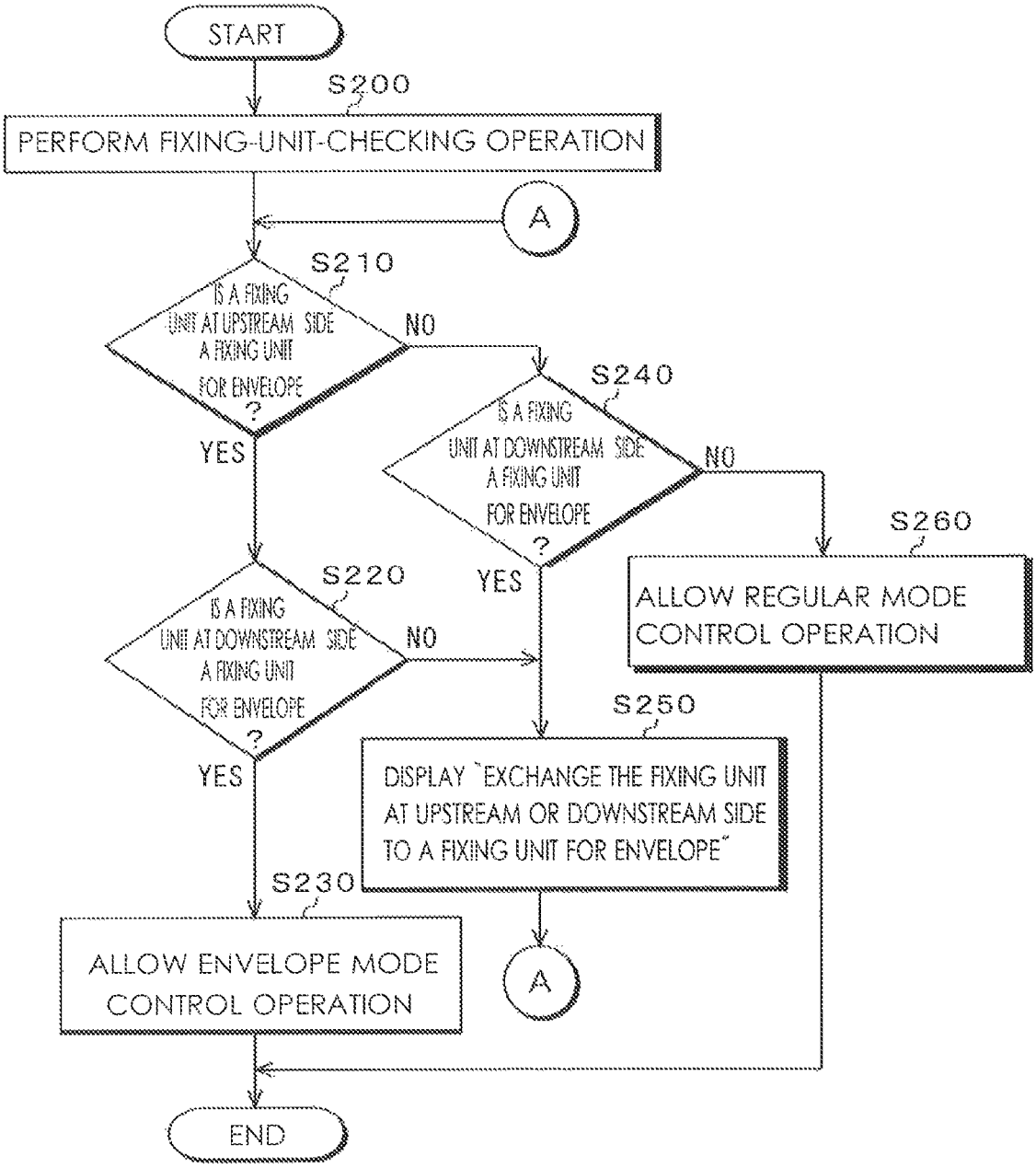
FIG. 4 is a flowchart showing an operation example of an image forming apparatus according to a second embodiment of this invention daring an operation time for checking fixing units.

FIG. 4 snows an operation example of the image forming apparatus GS according to the second embodiment of this invention during an operation tune for checking fixing units. The following will describe a case where she control unit 350 of the second copying portion 300 is a main controller and controls the image forming apparatus GS together with the control unit 150 of the first copying portion 100 and the control unit 250 of the intermediate transporting unit 200.

As shown in FIG. 4, at a step S200, the control unit 350 performs a fixing-unit-checking operation to check the fixing units at an initialization operation thereof when the power of image forming apparatus GS is on. At a step S210, the control unit 350 determines whether or not the fixing unit 120 of the first copying portion 100 is a fixing unit for the envelope. As the determination method, for example, it is determined based on whether or not a flag is set to a port indicating the fixing unit for the envelope, as described above. The control unit 350 goes to a step S220 when it determines that the fixing unit 120 of the first copying portion 100 is a fixing unit for the envelope. The control unit 350 goes to a step S240 when it determines that the fixing unit 120 of the first copying portion 100 is not a fixing unit for the envelope.

When the control unit 350 determines that the fixing unit 120 of the first copying portion 100 is a fixing unit for the envelope, at the step S220, the control unit 350 determines whether or net the fixing unit 320 of the second copying portion 300 is a fixing unit for the envelope. As the determination method, it is determined based on whether or not a flag is set to a port indicating the fixing unit for the envelope, as described above. The control unit 350 goes to a step S230 when it determines that the fixing unit 320 of the second copying portion 300 is a fixing unit for the envelope. The control unit 350 goes to a step S250 when it determines that the fixing unit 320 of the second copying portion 300 is not a fixing unit for the envelope.

When the control unit 350 determines that the fixing unit 320 of the second copying portion 300 at downstream side is a fixing unit for the envelope, in other words, when both of the fixing units of the first and second copying portions at upstream and downstream sides are determined so as to be fixing units for the envelope, at the step S230, the control unit 350 allows an envelope mode control operation to form the first and second images on the envelope. Accompanying this allowance of the envelope mode control operation, the control unit 350 applies a change and an adjustment control of sheet-transporting speed for the fixing unit for the envelope, a temperature control in the fixing unit for the envelope and an output control in various kinds of high voltage power source for the envelope. Thus, the image forming apparatus GS prints or copies the images on the envelope P under an optimal fixing condition for the envelope.

On the other hand, when the control unit 350 determines that the fixing unit 120 of the first copying portion 100 is not a fixing unit for the envelope, at the step S240, the control unit 350 determines whether or not the fixing unit 320 of the second copying portion 300 at downstream side is a fixing unit for the envelope. As the determination method, it is determining based on whether or not a flag is set to a port indicating the fixing unit for the envelope, as described above. The control unit 350 goes to a step S250 when it determines that the fixing unit 320 of the second copying portion 300 is a fixing unit for the envelope. The control unit 350 goes to a step S260 when it determines that the fixing unit 320 of the second copying portion 300 is not a fixing unit for the envelope.

At the step S250, the control unit 300 controls the manipulation and display unit 340 to display on the management screen thereof a guidance for urging a user to exchange the fixing unit 120 or 320, for example, "Please change the fixing unit at upstream side or downstream side from the existing fixing unit to a fixing unit for the envelope". In this moment, a speaker may be provided to carry out guidance by voice in addition to the displayed guidance. An alarm may sound by buzzer. The control unit 300 goes back to the step S210, after she guidance has been displayed on the screen, where the control unit 350 again determines whether or not the fixing unit 120 of the first copying portion 100 at upstream side or the fixing unit 520 of the second copying portion 300 at downstream side is exchanged to a fixing unit for the envelope based on the displayed guidance.

Further, when the control unit 350 determines that neither the fixing unit 120 of the first copying portion 100 nor the fixing unit 320 of the second copying portion 300 is a fixing unit for rise envelope, at the step S260, the control unit 350 allows a regular mode control operation to form the images on a regular sheet of paper. Accompanying this allowance of the regular mode control operation, the control unit 350 applies a change and an adjustment control of sheet-transporting speed for the fixing unit for a regular sheet of paper, a temperature control in the fixing unit for the regular sheet of paper and an output control in various kinds of high voltage power source for the regular sheet of paper. Thus, the image art forming apparatus GS according to this embodiment prints or copies the usages on the regular sheet of paper under an optimal fixing condition for the regular sheet of paper. In the image forming apparatus GS according to this embodiment, such a series of operations is repeated.

As described above, in the second embodiment, the control unit 350 allows the envelope mode control operation when both of the fixing units 120, 320 of the first and second copying portions 100, 300 are determined so as to be fixing units for the envelope. The control unit 350 also allows the regular mode control operation when neither the fixing unit 120 of the first copying portion 100 nor the fixing unit 320 of the second copying portion 300 is determined so as to be fixing units for the envelope. Accordingly, when printing or copying the images on the envelope P, a fixing condition such as temperature control, fixing speed, nipping width between the fixing rollers and nipping pressure is made optimal for the envelope. This avoids the envelope from suffering any creases in the fixing process. Similarly, when printing or copying the images on the regular sheet of paper, the fixing condition is made optimal for the regular sheet of paper. This prevents fixing quantity from being degraded. Thru, the image forming apparatus GS according so this embodiment can perform high quality printing or copying.

3. Third Embodiment

The third embodiment is different from the first embodiment in that a user can select the envelope mode or the regular mode on the management screen of the manipulation and display unit 340. It is to be noted that other components and operations of the image forming apparatus GS according to this embodiment are identical to those of the first embodiment so that the identical components are indicated by the same reference numbers, a detailed explanation of which will be omitted.

[Configuration Example of Image Forming Apparatus GS]

The management screen (menu screen) of the manipulation and display unit 340 in the image forming apparatus GS according to the third embodiment of this invention includes a button for the regular mode to print or copy the images on the regular sheet of paper such as a sheet of paper of A3 or A4 size and a button for the envelope mode to print or copy the images on the envelope P, as a fixing operation mode according to species of the sheet of paper. The user can select any of these buttons on the management screen. When the user selects any of these buttons on the management screen of the manipulation and display unit 340, the control unit 350 starts the fixing-unit-checking operation to check the fixing units and determines whether or not both of the fixing wart 120 of the first copying portion 100 at upstream side and the fixing unit 320 or the second copying portion 300 at downstream side are fixing units for the envelope.

Operation Example of Image Forming Apparatus GS

Figure 5:
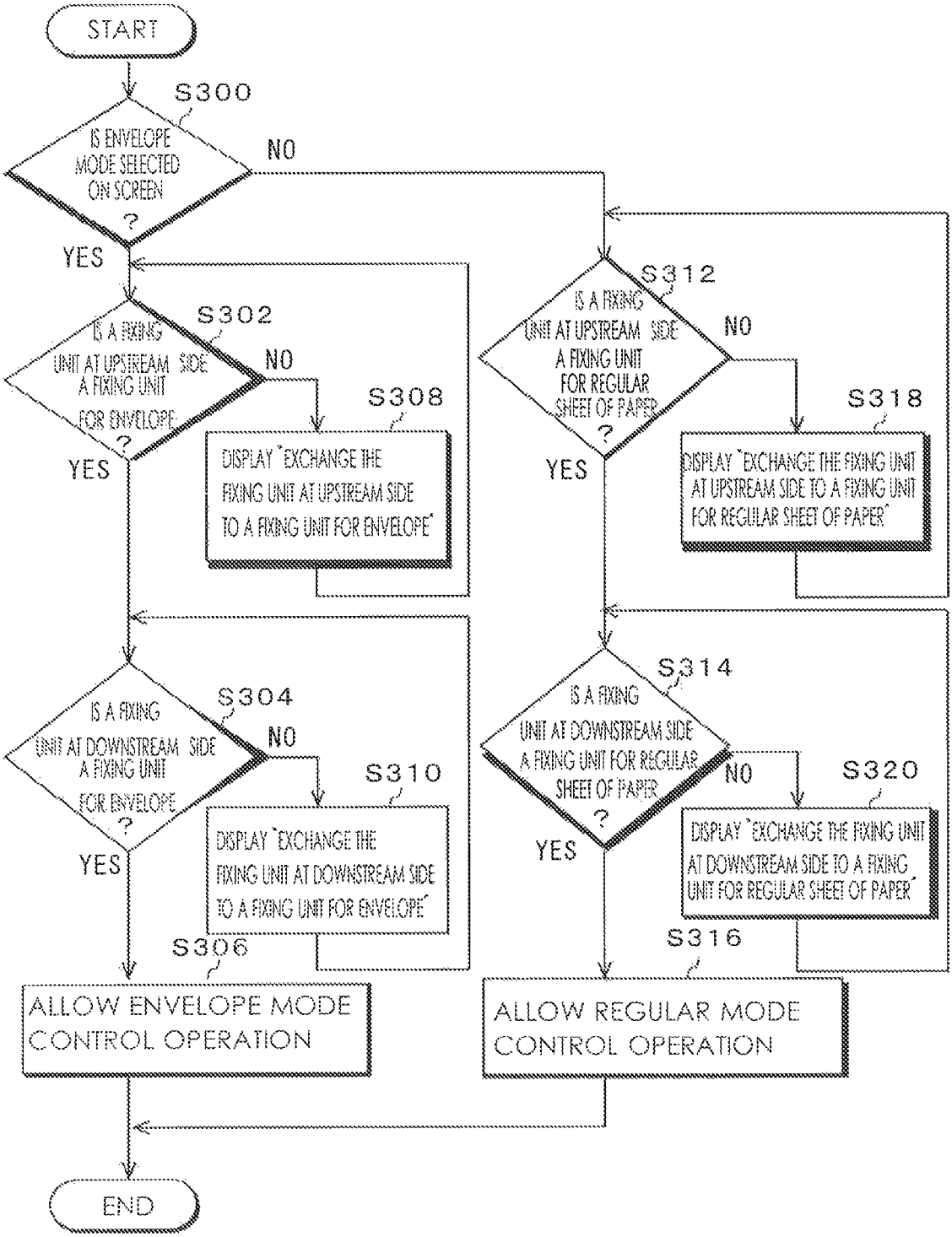
FIG. 5 is a flowchart showing an operation example of an image forming apparatus according to a third embodiment of this invention daring an operation time for checking fixing units.

The following will describe an operation example of the image forming apparatus according to the third embodiment of this invention. FIG. 5 shows an operation example of the image forming apparatus according to the third embodiment of this invention during an operation time for checking fixing units. The following will describe a case where the control unit 350 of the second copying portion 300 is a main controller and controls the image forming apparatus GS together with the control unit 150 of the first copying portion 100 and the control unit 250 of the intermediate transporting unit 200.

As shown in FIG. 5, at a step S300, the control unit 350 determines whether or not the use selects the envelope mode on the management screen of the manipulation and display unit 340. The control unit 350 goes to a step S302 when it determines that the user selects the envelope mode. The control unit 350 goes to a step S312 when it determines that the user selects, for example, the regular mode, not the envelope mode.

When fine user selects the envelope mode on the management screen of the manipulation and display unit 320, at the step S302, the control unit 350 determines whether or not the fixing unit 120 of the first copying portion 100 is a fixing unit for the envelope. As the determination method, for example, it is determined based on whether or not a flag is see to a port indicating the fixing unit for the envelope, as described above. The control unit 350 goes to a step S304 when it determines that the fixing unit 120 of the first copying portion 100 is a fixing unit for the envelope. The control unit 350 goes to a step S308 when it determines that the fixing unit 120 of the first copying portion 100 is not a fixing unit for the envelope.

When the control unit 350 determines that the fixing unit 120 of the first copying portion 100 is not a fixing unit for the envelope, at the step S308, the control unit 350 controls the manipulation and display unit 340 to display on the management screen thereof a guidance for urging a user to exchange the fixing unit 120, for example, "Please exchange the fixing unit at upstream side from the existing fixing unit to a fixing unit for the envelope". In this moment, a speaker may be provided to carry out guidance by voice in addition to the displayed guidance. An alarm may sound by buzzer. The control unit 350 goes back to the step S302, after the guidance has been displayed on the screen, where the control unit 350 again determines whether or not the fixing unit 120 of the first copying portion 100 is exchanged to a fixing unit for the envelope based on the displayed guidance.

On the other hand, when the control unit 350 determines that the fixing unit 120 of the first copying portion 100 is a fixing unit for the envelope, at the step S304, the control unit 350 determines whether or not the fixing unit 320 of the second copying portion 300 at downstream side is a fixing unit for the envelope. As the determination method, it is determined based en whether or not a flag is set to a port indicating the fixing unit for the envelope, as described above. The control unit 350 goes to a step S305 when it determines that the fixing unit 320 of the second copying portion 300 is a fixing unit for the envelope. The control unit 350 goes to a step S310 when it determines that the fixing unit 320 of the second copying portion 300 is not a fixing unit for the envelope.

When the control unit 350 determines that the fixing unit 320 of the second copying portion 300 is not a fixing unit for the envelope, at the step S310, the control unit 350 controls the manipulation and display unit 340 to display on the management screen thereof a guidance for urging a user to exchange the fixing unit 320, for example, "Please exchange the fixing unit at downstream side from the existing fixing unit to a fixing unit for the envelope". In this moment, a speaker may be provided to carry cost guidance by voice in addition to the displayed guidance. An alarm may sound by buzzer. The control unit 350 goes back to the step S304, after the guidance has been displayed on the screen, where the control unit 350 again determines whether or not the fixing unit 320 of the second copying portion 300 at downstream side is exchanged to a fixing unit for the envelope based on the displayed guidance.

When the control unit 350 determines that the fixing unit 320 of the second copying portion 300 at downstream side is a fixing unit for the envelope, in other words, when both of the fixing units of the first and second copying portions at upstream and downstream sides are determined so as to be fixing units for the envelope, at the step S306, the control unit 350 allows an envelope mode control operation to form the first and second images on the envelope. Accompanying this allowance of the envelope mode control operation, the control unit 350 applies a change and an adjustment control of sheet-transporting speed for the fixing unit for the envelope, a temperature control in the fixing unit for the envelope and an output control in various kinds of high voltage power source for the envelope. Thus, the image forming apparatus GS according to this embodiment prints or copies the images on the envelope P under an optimal fixing condition for the envelope P.

On the other hand, when the user selects the regular mode on the management screen of the manipulation and display unit 340, at the step S312, the control unit 350 determines whether or not the fixing unit 120 of the first copying portion 100 is a fixing unit for the regular sheer of paper. As the determination method, for example, it is determined based on whether or not a flag is set to a port indicating the fixing unit for the regular sheet of paper, as described above. The control unit 350 goes to a step S314 when if determines that the fixing unit 120 of the first copying portion 100 is a fixing unit for the regular sheet of paper. The control unit 350 goes to a step S318 when it determines that the fixing unit 120 of the first copying portion 100 is not a fixing unit for the regular sheet of paper.

When the control unit 350 determines that the fixing unit 120 of the first copying portion 100 is not a fixing unit for the regular sheet of paper, at the step S318, the control unit 350 controls the manipulation and display unit 340 to display on the management screen thereof a guidance for urging a user to exchange the fixing unit 120, for example, "Please exchange the fixing unit at upstream side from the existing fixing unit to a fixing unit for the regular sheet of paper". In this moment, a speaker may be provided to carry out guidance by voice in addition to the displayed guidance. An alarm may sound by buzzer. The control unit 350 goes back to the step S312, after the guidance has been displayed on the screen, where the control unit 350 again determines whether or not the fixing unit 120 of the first copying portion 100 is exchanged to a fixing unit for the regular sheet of paper based on the displayed guidance.

On the other hand, when the control unit 350 determines that the fixing unit 120 of the first copying portion 100 is a fixing unit for the regular sheet of papery at a step S314, the control unit 350 determines whether or not the fixing unit 320 of the second copying portion 300 is a fixing unit for the regular sheet of paper. As the determination method, it is determined based on whether or not a flag is set to a port indicating the fixing unit for the regular sheet of paper, as described above. The control unit 350 goes to a step S316 when it determines that the fixing unit 320 of the second copying portion 300 is a fixing unit for the regular sheet of paper. The control unit 350 goes to a step S320 when it determines that the fixing unit 320 of the second copying portion 300 is not a fixing unit for the regular sheet of paper.

When the control unit 350 determines that the fixing unit 320 out the second copying portion 300 is not a fixing unit for the regular sheet of paper, at the step S320, the control unit 350 controls the manipulation and display unit 340 to display on the management screen thereof a guidance for urging a user to exchange the fixing unit 320, for example, "Please exchange the fixing unit at downstream side from the existing fixing unit to a fixing unit for the regular sheet of paper". In this moment, a speaker may be provided to carry out guidance by voice in addition to the displayed guidance. An alarm may sound by buzzer. The control unit 350 goes tack to the step S314, after the guidance has been displayed on the screen, where the control unit 350 again determines whether or not the fixing unit 320 of the second copying portion 300 is exchanged to a fixing unit for the regular sheet of paper based on the displayed guidance.

When the control unit 350 determines that the fixing unit 320 of the second copying portion 300 at downstream side is a fixing unit for the regular sheet of paper, in other words, when both of the fixing units of the first and second copying portions at upstream and downstream sides are determined so as to be fixing units for the regular sheet of paper, at the step S316, the control unit 350 allows a regular mode control operation to form the first and second images on the regular sheet of paper. Accompanying this allowance of the regular mode control operation, the control unit 350 applies a change and an adjustment control of sheet-transporting speed for the fixing unit for the regular sheet of paper, a temperature control in the fixing unit for the regular sheet of paper and an output control in various kinds of high voltage power source for the regular sheet of paper. Thus, the image forming apparatus GS according to the third embodiment prints or copies the images on the regular sheet of paper under an optimal fixing condition for the regular sheet of paper. In the image forming apparatus GS according to the third embodiment, such a series of operations is repeated.

As described above, according to the third embodiment, it is possible to accomplish an effect similar to those of the first and second embodiments. In the third embodiment, the envelope mode and the like may be selected on the management screen of the manipulation and display unit 340 and when selecting this envelope mode, the fixing-unit-checking operation to check the fixing units is performed so that it is possible to print or copy the images on the sheet of paper including the envelope surely under fixing condition which is suitable for species of the sheet of paper.

4. Fourth Embodiment

The fourth embodiment is different from the first through third embodiments in that a user can select the envelope as setting item of a sheet-feeding tray on the management screen of the manipulation and display unit 340, it is to be noted that other components and operations of the image forming apparatus GS according to this embodiment are identical to those of the first embodiment and the like so chat the identical components are indicated by the same reference cambers, a detailed explanation of which will be omitted.

Configuration Example of Image Forming Apparatus GS

The management screen (menu screen) of the manipulation and display unit 340 in the image forming apparatus GS according to the fourth embodiment of this invention includes, as setting items for the sheet-feeding tray, a regular sheet button for the regular sheet of paper such as a sheet of paper of A3 or A4 size and a button for tire envelope. The user selects any of these buttons on the management screen. For example, when the user selects any of plural sheet-feeding trays on the management screen of the manipulation and display unit 340, the control unit 350 controls the manipulation and display unit 340 to display plural buttons such as a regular sheet button for a regular sheet of paper of A3 site and a button for the envelope, as the buttons for the sheet of papers which can be set in this selected sheet-feeding tray. The user can select the regular sheet button or the button for the envelope for the selected sheet-feeding tray. Accordingly, the envelope F can be selected as a sheet of paper to be set in the selected sheet-feeding tray.

When the user selects the button for the envelope on the management screen of the manipulation and display unit 340 and selects the sheet-feeding tray in which the envelope is set, the control unit 350 starts the fixing-unit-checking operation to check the fixing units and determines whether or not both of the fixing unit 120 of the first copying portion 100 and the fixing unit 320 of the second copying portion 300 are fixing units for the envelope.

Operation Example of Image Forming Apparatus GS

Figure 6:
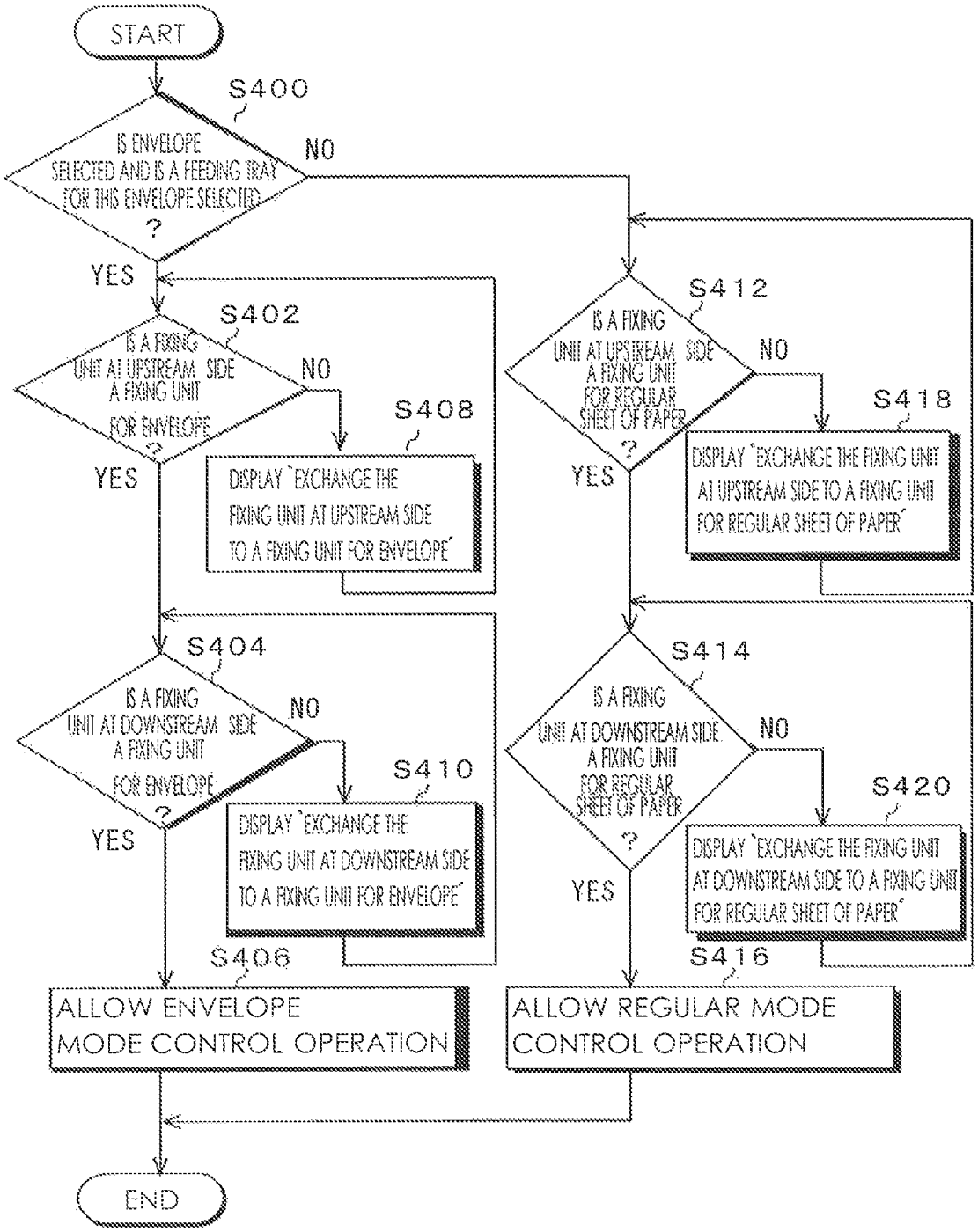
FIG. 6 is a flowchart showing an operation example of an image forming apparatus according to a fourth embodiment of this invention during an operation time for checking fixing units.

The following will describe an operation example of the image forming apparatus GS according to the fourth embodiment of this invention. FIG. 6 shows an operation example of the image forming apparatus according to the fourth embodiment of this invention during an operation time for checking the fixing units. The following will describe a case where the control unit 330 of the second copying portion 300 is a main controller and controls the image forming apparatus GS together with the control unit 350 of the first copying portion 100 and the control unit 250 of the intermediate transporting unit 200. It is to be noted that operations of the steps S402 through S420 are identical to those of the steps S302 through S320 shown in FIG. 5, which have been described in the third embodiment, so that the description thereof will be simplified or omitted.

At a step S400, the control unit 350 determines whether or not the user selects the envelope P as species of the sheet of paper for the sheet-feeding tray and the sheet-feeding tray in which the envelope is set on the management screen of the manipulation and display unit 340. Namely, the control unit 350 determines whether or not the sheet-feeding tray selected on the management screen is set for the envelope. The control unit 350 goes to a step S402 when it determines that the selected sheet-feeding tray is set for the envelope and the envelope mode is set. The control unit 350 goes to a step S412 when it determines that the selected sheet-feeding tray is not set for the envelope and the regular mode is set.

When the selected sheet-feeding tray is set for the envelope, at the steps S402 and S404, the control unit 350 determines whether or not the fixing unit 120 of the first copying portion 100 and the fixing unit 320 of the second copying portion 300 are fixing units for the envelope. When determining that both of the fixing unit 120 of the first copying portion 100 and the fixing unit 320 of rise second copying portion 300 are the fixing units for the envelope, the control unit 350 allows the envelope mode control operation to font the first and second images on the envelope at the step S406. When any one of the fixing unit 120 of the first copying portion 100 and the fixing unit 320 of the second copying portion 300 is not the fixing unit for the envelope, the control unit 350 controls the manipulation and display unit 340 to display on the management screen thereof a guidance for urging a user to exchange the fixing unit from the existing fixing unit to the fixing unit for the envelope, at the steps S408, S410.

On the other hand, when the selected sheet-feeding tray is not set for the envelope, at the steps S412 and S414, the control unit 350 determines whether or not the fixing unit 120 of the first copying portion 100 and the fixing unit 320 of the second copying portion 300 are fixing units for the regular sheet of paper. When determining that both of the fixing unit 120 of the first copying portion 100 and the fixing unit 320 of the second copying portion 300 are the fixing units for the regular sheet of paper, the control unit 350 allows the regular mode control operation to form the first and second images on the regular sheet of paper at the step S416. When any one of the fixing unit 120 of the first copying portion 100 and the fixing unit 320 of the second copying portion 300 is not the fixing unit for the regular sheet of paper, the control unit 330 controls the manipulation and display unit 340 to display on the management screen thereof a guidance for urging a user to exchange the fixing unit from the existing fixing unit to the fixing unit for the regular sheet of paper, at the steps S418, S420.

As described above, according to the fourth embodiment, it is possible to accomplish an effect similar to those of the first and second embodiments. In the fourth embodiment, the regular sheet of paper or the envelope P may be selected as setting items for the selected sheet-feeding fray on the management screen of the manipulation and display unit 340 and when selecting the regular sheet of paper or the envelope P, the fixing-unit-checking operation to check the fixing units is performed so that it is possible to print or copy the usages on the sheet of paper including the envelope surely under fixing conditions which are suitable for species of the sheet of paper.

5. Fifth Embodiment

The fifth embodiment is different from the first embodiment in that a detection part 132 of the sheet-feeding unit 130 detects whether or not the envelope or the like is set in the selected sheet-feeding tray. It is to be noted that other components and operations of an image forming apparatus GSA according to this embodiment are identical to those of the first embodiment so that the identical components are indicated by the same reference numbers, a detailed explanation of which will be omitted.

Figure 7:
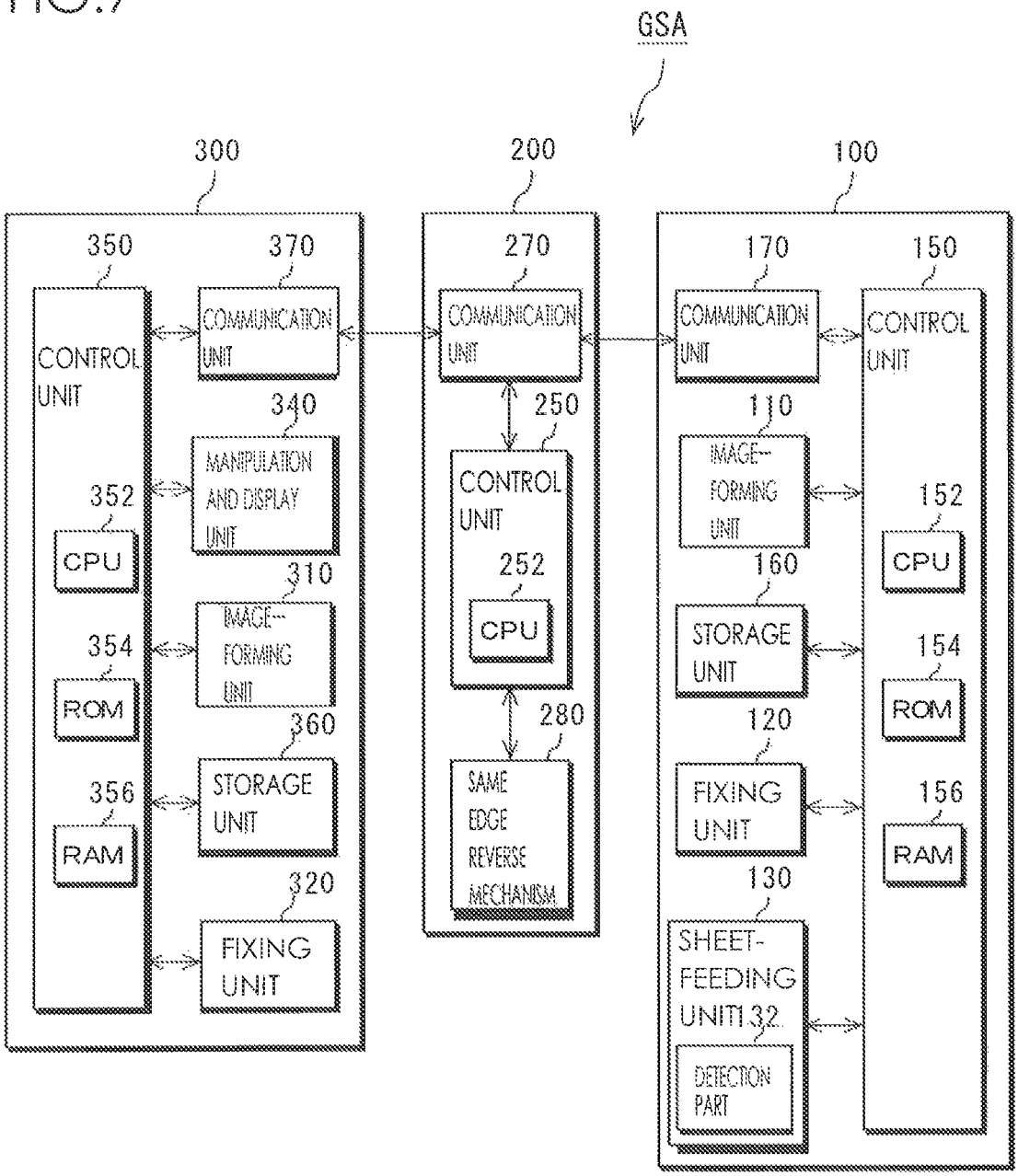
FIG. 7 is a block diagram showing a configuration example of an image forming apparatus according to a fifth embodiment of this invention.

FIG. 7 shows a configuration example of the image forming apparatus GSA according to the fifth embodiment of this invention. As shown in FIG. 7, the sheet-feeding unit 130 of the first copying portion 100 includes the detection part 132 that automatically detects a species of the sheet of paper including the envelope P set in the sheet-feeding tray. The detection part 132 is composed of, for example, an imaging apparatus including CCD image sensor or CMOS image securer, a double-feeding detection sensor using ultrasonic wave or the like. The detection part 132 acquires any sheet information based on image data of the sheet of paper set in the sheet-feeding tray, fade-out ultrasonic wave or the like and supplies the acquired sheet information to the control unit 350 of the second copying portion 300 at downstream side through the control unit 150 of the first copying portion 100.

The control unit 350 determines which sheet of paper set in the sheet-feeding tray of the sheet-feeding unit 130 is the regular sheet of paper or the envelope P based on the sheet information received from the detection part 132 of the first copying portion 100 through the communication units 170, 270 and 370. It is to be noted that a calculation part each as CPU provided in the sheet-feeding unit 130 may determine which sheet of paper set in the sheet-feeding tray of the sheet-feeding unit 130 is the regular sheet of paper or the envelope P.

Operation Example of Image Forming Apparatus GSA

Figure 8:
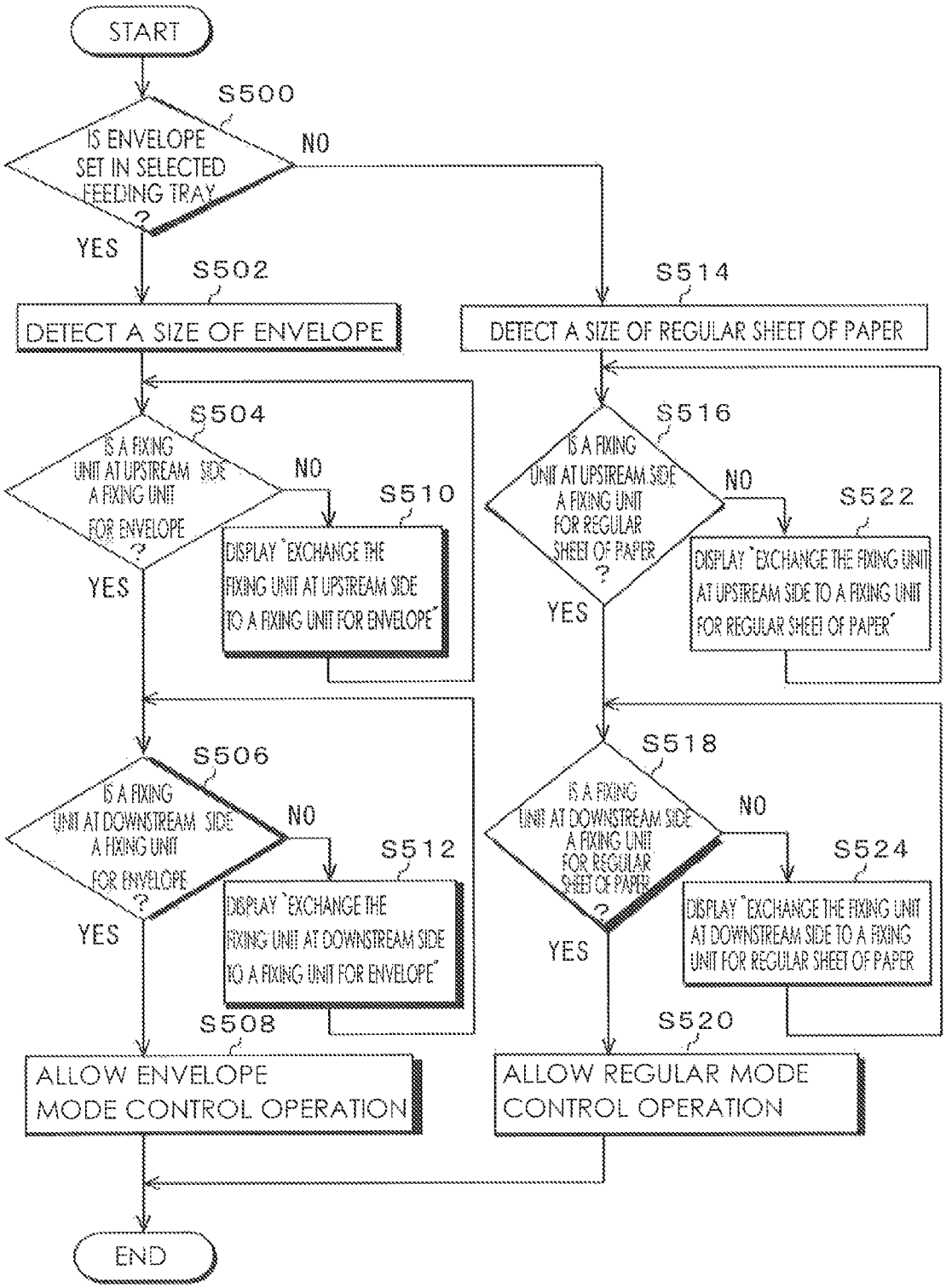
FIG. 8 is a flowchart showing an operation example of the image forming apparatus according to the fifth embodiment of this invention during an operation time for checking fixing units.

FIG. 8 shows an operation example of the image forming apparatus GSA according to the fifth embodiment of this invention during an operation time for checking the fixing units. The following will describe a case where the control unit 350 of the second copying portion 300 is a main controller and controls the image forming apparatus GSA together with the control unit 150 of the first copying portion 100 and the control unit 250 of the intermediate transporting unit 200. It is to be noted that operations of the steps other than the steps S500, S502 and S504 are almost identical to those of the steps S302 through S316 shown in FIG. 5, which have been described in the third embodiment, so that the description thereof will be simplified or omitted.

At the step S500, the control unit 350 acquires the sheet information from the detection part 132 of the first copying portion 100 when setting the sheet of paper in the selected sheet-feeding tray in the sheet-feeding unit 130. The control unit 350 then determines which sheet of paper set in the selected sheet-feeding tray is the regular sheet of paper or the envelope based on the acquired sheet information. The control unit 350 goes to the step S502, when it determines that the envelope P is set in the selected sheet-feeding tray, where a size of the era/elope is detected and then goes to the step S504. On the other hand, the control unit 350 goes to the step S514, when it determines that the regular sheet of paper is set an the selected sheet-feeding tray, where a size of the regular sheet of paper is detected and then goes to the step S516.

When the envelope P is set in the selected sheet-feeding tray, at the steps S504 and S506, the control unit 330 determines whether or not the fixing unit 120 of the first copying portion 100 at upstream side and the fixing unit 320 of the second copying portion 300 at downstream side are fixing units for the envelope. When determining that both of the fixing unit 120 of the first copying portion 100 and the fixing unit 320 of the second copying portion 300 are the fixing units for the envelope, the control unit 350 allows the era/elope mode control operation to form the first and second images on the envelope P at a step S508. When any one of the fixing unit 120 of the first copying portion 100 and the fixing unit 320 of the second copying portion 300 is not the fixing unit for the envelope, the control unit 350 controls the manipulation and display unit 340 to display on the management screen thereof a guidance for urging a user to exchange the fixing unit from the existing fixing unit to the fixing unit for the envelope, at the steps S510 and S512.

On the other hand, when the regular sheet of paper is set in the selected sheet-feeding tray, at the steps S516 and S518, the control unit 350 determines whether or not the fixing unit 120 of the first copying portion 100 at upstream side and the fixing unit 320 of the second copying portion 300 at downstream side are fixing units for the regular sheet of paper. When determining that both of the fixing unit 120 of the first copying portion 100 and the faxing unit 320 of the second copying portion 300 are the fixing units for the regular sheet of paper, the control unit 350 allows she regular mode control operation to form the first, and second images on the regular sheet of paper at the step S520. When any one of the fixing unit 120 of the first copying portion 100 and the fixing unit 320 of the second copying portion 300 is not the fixing unit for the regular sheet of paper, the control unit 350 controls the manipulation and display unit 340 to display on the management screen thereof a guidance for urging a user to exchange the fixing unit from the existing fixing unit to the fixing unit for the regular sheet of paper, at the steps S522 and S524.

As described above, according to the fifth embodiment, it is possible to accomplish an effect similar to those of the first and second embodiments. In the fifth embodiment, the control unit 350 determines a species of the sheet of paper based on the sheet information on the sheet of paper set in the selected sheet-feeding tray, which is defected by the detection part 132 of the sheet-feeding unit 130, and performs the fixing-unit-checking operation for checking the fixing units according to the species of the sheet of paper so that it is possible to print or copy the images on the sheet of paper including the envelope surely under fixing conditions which are suitable for the species of the sheet or paper.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

Although, in the above-mentioned first through fifth embodiments, it has been described that the control unit 350 of the second copying portion 300 is a main controller and controls the image forming apparatus together with the control unit 150 of the first copying portion 100 and the control unit 250 of the intermediate transporting unit 200, this invention is not limited thereto. For example, the control unit 150 of the first copying portion 100 or the control unit 250 of the intermediate transporting unit 200 may be a main controller.

Although, in the above-mentioned first through fifth embodiments, an image forming apparatus of tandem type has been described in which the first copying portion 100 and the second copying portion 300, which have the same function as each other, are connected in series to perform duplex printing, this invention is not limited thereto. An image forming apparatus may be configured as one piece by including the first and second copying portions and the intermediate transporting portion in one case.

Although, in the above-mentioned first through fifth embodiments, it has been described that the same edge reverse mechanism 280 of the intermediate transporting unit 200 has a reverse path of loop shape, which is arranged in a direction which is perpendicular to the transporting direction D of the sheet of paper, and passes the sheet of paper through the reverse path of loop shape to turn it by 180 degrees so that a surface of the sheet of paper is reversed, this invention is not limited thereto. Another reverse mechanism may be used. For example, a reverse mechanism to twist the sheet of paper by 180 degrees along the transporting direction D of the sheet of paper so that a surface of the sheet of paper is reversed may be used.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus comprising:

a first copying portion including a first image forming unit that forms a first image on a sheet of paper containing an envelope, and a first fixing unit that fixes the first image formed by the first copying portion on the sheet of paper containing the envelope;

a second copying portion including a second image forming unit that forms a second image on the sheet of paper containing the envelope, and a second fixing unit that fixes the second image formed by the second copying portion on the sheet of paper containing the envelope, the second copying portion being connected in series to the first copying portion at downstream side of the first copying portion along a transporting direction of the sheet of paper;

a control portion that is configured to watch the first and second fixing units and to allow an envelope mode control operation to form the first and second images on the envelope when determining that both of the first and second fixing units are fixing units for the envelope, which fix the first and second images on the envelope; and an informing portion that urges a user to exchange at least one of the first and second fixing units, wherein when determining that any one of the first and second fixing units is the fixing unit for the envelope, the control portion is configured to control the informing portion to inform the user of a guidance for exchanging the other fixing unit which is determined to be not the fixing unit for the envelope from the existing fixing unit to the fixing unit for the envelope.

2. The image forming apparatus of claim 1, wherein when determining that both of the first and second fixing units are fixing units for a regular sheet of paper, which fix the first and second images on the regular sheet of paper, the control portion is configured to allow a regular mode control operation to form the first and second images on the regular sheet of paper.

3. The image forming apparatus of claim 1, further comprising a manipulation portion which selects the envelope mode control operation, wherein the control portion is configured to allow the envelope mode control operation when the manipulation portion selects the envelope mode control operation and the control portion determines that both of the first and second fixing units are the fixing units for the envelope.

4. The image forming apparatus of claim 3 wherein the manipulation portion is configured to be able to select a regular mode control operation to form the first and second images on a regular sheet of paper, and the control portion is configured to allow the regular mode control operation when the manipulation portion selects the regular mode control operation and the control portion determines that both of the first and second fixing units are fixing units for the regular sheet of paper, which fix the first and second images on the regular sheet of paper.

5. The image forming apparatus of claim 1, further comprising plural sheet-feeding trays, each tray setting the sheet of paper including the envelope; and a manipulation portion which selects the envelope as a setting item for the sheet-feeding trays, wherein the control portion is configured to allow the envelope mode control operation when the manipulation portion selects the envelope as the setting for the sheet-feeding trays and selects the sheet-feeding tray in which the envelope is set and the control portion determines that both of the first and second fixing units are fixing units for the envelope.

6. The image forming apparatus of claim 1, further comprising:

a sheet-feeding tray that sets the sheet of paper including the envelope; and a detecting unit that detects whether or not the envelope is set in the sheet-feeding tray, wherein the control portion is configured to allow the envelope mode control operation when determining that the envelope is set in the sheet-feeding tray based on a result of the detection by the detecting unit and determining that both of the first and second fixing units are fixing units for the envelope.

7. The image forming apparatus of claim 1, further comprising an intermediate transporting portion that is positioned between the first and second copying portions and transports the sheet of paper including the envelope transported from the first copying portion to the second copying portion while a surface of the sheet of paper is reversed without any interchange of front and behind in the sheet of paper.

8. An image forming apparatus comprising:

a first copying portion including a first image forming unit that forms a first image on a sheet of paper containing an envelope, and a first fixing unit that fixes the first image formed by the first copying portion on the sheet of paper containing the envelope;

a second copying portion including a second image forming unit that forms a second image on the sheet of paper containing the envelope, and a second fixing unit that fixes the second image formed by the second copying portion on the sheet of paper containing the envelope, the second copying portion being connected in series to the first copying portion at downstream side of the first copying portion along a transporting direction of the sheet of paper;

a control portion that is configured to watch the first and second fixing units and to allow an envelope mode control operation to form the first and second images on the envelope when determining that both of the first and second fixing units are fixing units for the envelope, which fix the first and second images on the envelope;

plural sheet-feeding trays, each tray setting the sheet of paper including the envelope; and a manipulation portion which selects the envelope as a setting item for the sheet-feeding trays, wherein the control portion is configured to allow the envelope mode control operation when the manipulation portion selects the envelope as the setting item or the sheet-feeding trays and selects the sheet-feeding tray in which the envelope is set and the control portion determines that both of the first and second fixing units are fixing units for the envelope.

9. The image forming apparatus of claim 8, further comprising an intermediate transporting portion that is positioned between the first and second copying portions and transports the sheet of paper including the envelope transported from the first copying portion to the second copying portion while a surface of the sheet of paper is reversed without any interchange of front and behind in the sheet of paper.

10. An image forming apparatus comprising:

a first copying portion including a first image forming unit that forms a first image on a sheet of paper containing an envelope, and a first fixing unit that fixes the first image formed by the first copying portion on the sheet of paper containing the envelope;

a second copying portion including a second image forming unit that forms a second image on the sheet of paper containing the envelope, and a second fixing unit that fixes the second image formed by the second copying portion on the sheet of paper containing the envelope, the second copying portion being connected in series to the first copying portion at downstream side of the first copying portion along a transporting direction of the sheet of paper;

a control portion that is configured to watch the first and second fixing units and to allow an envelope mode control operation to form the first and second images on the envelope when determining that both of the first and second fixing units are fixing units for the envelope, which fix the first and second images on the envelope;

a sheet-feeding tray that sets the sheet of paper including the envelope; and a detecting unit that detects whether or not the envelope is set in the sheet-feeding tray, wherein the control portion is configured to allow the envelope mode control operation when determining that the envelope is set in the sheet-feeding tray based on a result of the detection by the detecting unit and determining that both of the first and second fixing units are fixing units for the envelope.

11. The image forming apparatus of claim 10, further comprising an intermediate transporting portion that is positioned between the first and second copying portions and transports the sheet of paper including the envelope transported from the first copying portion to the second copying portion while a surface of the sheet of paper is reversed without any interchange of front and behind in the sheet of paper.

12. An image forming apparatus comprising:

a first copying portion including a first image forming unit that forms a first image on a sheet of paper containing an envelope, and a first fixing unit that fixes the first image formed by the first copying portion on the sheet of paper containing the envelope;

a second copying portion including a second image forming unit that forms a second image on the sheet of paper containing the envelope, and a second fixing unit that fixes the second image formed by the second copying portion on the sheet of paper containing the envelope, the second copying portion being connected in series to the first copying portion at downstream side of the first copying portion along a transporting direction of the sheet of paper;

a control portion that is configured to watch the first and second fixing units and to allow an envelope mode control operation to form the first and second images on the envelope when determining that both of the first and second fixing units are fixing units for the envelope, which fix the first and second images on the envelope;

wherein the first fixing unit includes a regular fixing unit for a regular sheet of paper and an envelope fixing unit for the envelope as species of the first fixing unit, the regular fixing unit and the envelope fixing unit of the first fixing unit being exchanged according to species of the sheet of paper to be used;

wherein the second fixing unit include a regular fixing unit for a regular sheet of paper and an envelope fixing unit for the envelope as species of the second fixing unit, the regular fixing unit and the envelope fixing unit of the second fixing unit being exchanged according to species of the sheets of papers to be used; and wherein in each of the first fixing unit and the second fixing unit, the regular fixing unit and the envelope fixing unit are separate units.

13. The image forming apparatus of claim 12, further comprising:

an informing portion that urges a user to exchange at least one of the first and second fixing units, wherein when determining that any one of the first and second fixing units is the fixing unit for the envelope, the control portion is configured to control the informing portion to inform the user of a guidance for exchanging the other fixing unit which is determined to be not the fixing unit for the envelope from the existing fixing unit to the fixing unit for the envelope.

14. The image forming apparatus of claim 12, wherein when determining that both of the first and second fixing units are fixing units for a regular sheet of paper, which fix the first and second images on the regular sheet of paper, the control portion is configured to allow a regular mode control operation to form the first and second images on the regular sheet of paper.

15. The image forming apparatus of claim 12, further comprising a manipulation portion which selects the envelope mode control operation, wherein the control portion is configured to allow the envelope mode control operation when the manipulation portion selects the envelope mode control operation and the control portion determines that both of the first and second fixing units are the fixing units for the envelope.

16. The image forming apparatus of claim 15 wherein the manipulation portion is configured to be able to select a regular mode control operation to form the first and second images on a regular sheet of paper, and the control portion is configured to allow the regular mode control operation when the manipulation portion selects the regular mode control operation and the control portion determines that both of the first and second fixing units are fixing units for the regular sheet of paper, which fix the first and second images on the regular sheet of paper.

17. The image form apparatus of claim 12, further comprising plural sheet-feeding trays, each tray setting the sheet of paper including the envelope; and a manipulation portion which selects the envelope as a setting item for the sheet-feeding trays, wherein the control portion is configured to allow the envelope mode control operation when the manipulation portion selects the envelope as the setting item for the sheet-feeding trays and selects the sheet-feeding tray in which the envelope is set and the control portion determines that both of the first and second fixing units are fixing units for the envelope.

18. The image forming apparatus of claim 12, further comprising:

a sheet-feeding tray that sets the sheet of paper including the envelope; and a detecting unit that detects whether or not the envelope is set in the sheet-feeding tray, wherein the control portion is configured to allow the envelope mode control operation when determining that the envelope is set in the sheet-feeding tray based on a result of the detection by the detecting unit and determining that both of the first and second fixing units are fixing units for the envelope.

19. The image forming apparatus of claim 12, further comprising an intermediate transporting portion that is positioned between the first and second copying portions and transports the sheet of paper including the envelope transported from the first copying portion to the second copying portion while a surface of the sheet of paper is reversed without any interchange of front and behind in the sheet of paper.

* * * * *